US011053687B1

(12) United States Patent
Oser

(10) Patent No.: US 11,053,687 B1
(45) Date of Patent: Jul. 6, 2021

(54) FASCIA SAVER DEVICE AND SYSTEM

(71) Applicant: Justin Oser, Battle Ground, WA (US)

(72) Inventor: Justin Oser, Battle Ground, WA (US)

( * ) Notice: Subject to any disclaimer, the term of this patent is extended or adjusted under 35 U.S.C. 154(b) by 0 days.

(21) Appl. No.: 16/657,871

(22) Filed: Oct. 18, 2019

Related U.S. Application Data

(60) Provisional application No. 62/750,634, filed on Oct. 25, 2018.

(51) Int. Cl.
*E04D 13/072* (2006.01)
*E04D 13/00* (2006.01)

(52) U.S. Cl.
CPC ..... *E04D 13/0725* (2013.01); *E04D 13/00* (2013.01)

(58) Field of Classification Search
CPC . E04D 13/0725; E04D 13/064; E04D 13/076; E04D 13/0765
USPC ..... 52/11
See application file for complete search history.

(56) References Cited

U.S. PATENT DOCUMENTS 1,414,345 A * 5/1922 Herman ..... E04D 13/0722 248/48.2
3,110,079 A * 11/1963 Novy ..... E04D 15/04 29/21.1
3,877,113 A * 4/1975 Reyes ..... F16G 11/106 24/115 M
3,915,418 A * 10/1975 D'Amato ..... E04D 13/0725 248/48.2
3,930,345 A * 1/1976 Kurzenberger ..... B60P 7/0823 52/23
4,033,535 A * 7/1977 Moran ..... F16L 5/00 248/56
4,086,736 A * 5/1978 Landrigan ..... F16L 5/04 248/56
4,185,421 A 1/1980 Robinson
4,640,479 A * 2/1987 Shely ..... H02G 3/0641 16/2.2
4,705,242 A 11/1987 Yost
(Continued)

FOREIGN PATENT DOCUMENTS

CA 2355273 A1 1/2003
CA 2751992 A 3/2013
GB 2420570 A 5/2006

OTHER PUBLICATIONS

The Family Handyman, "Easy Gutter Fixes" https://www.familyhandyman.com/roof/gutter-repair/easy-gutter-fixes/view-all/, retrieved Aug. 30, 2018, 31 pages.
(Continued)

*Primary Examiner* — Patrick J Maestri
*Assistant Examiner* — Joseph J. Sadlon
(74) *Attorney, Agent, or Firm* — Rylander & Associates, PC; Philip R. M. Hunt

(57) ABSTRACT

A facia saving gutter system comprising a gutter attached to a building, a fastener passing through the gutter and into the building, a ferule around the fastener and a fascia saver around the ferrule and contacting the back wall of the gutter to prevent water from seeping down the ferule, through a fastener hole in the back wall of the gutter and into a gap between the gutter and the building. The fascia saver has a truncated cone body of elastic material with a center cavity through the truncated cone body along a longitudinal axis of the truncated cone body, the truncated cone body with a longitudinal slit through the truncated cone body.

10 Claims, 3 Drawing Sheets

(56) References Cited

U.S. PATENT DOCUMENTS 4,757,649 A * 7/1988 Vahldieck ..... E04D 13/064 52/11
4,781,003 A * 11/1988 Rizza ..... E04B 1/6804 404/69
5,098,223 A * 3/1992 Schoenherr ..... E04D 13/0725 248/48.1
5,141,633 A * 8/1992 Walczak ..... B01D 35/02 210/163
5,236,340 A * 8/1993 Hall ..... A47J 47/18 220/482
5,246,754 A * 9/1993 Miller ..... B29B 17/0026 428/36.91
5,588,261 A * 12/1996 MacConochie ..... E04D 13/064 52/11
5,727,350 A 3/1998 Marcella
5,768,830 A * 6/1998 Kelly ..... E04D 13/0722 269/231
5,897,279 A 4/1999 Bentley
5,950,381 A * 9/1999 Stansbie ..... F16L 5/10 16/2.2
6,050,034 A * 4/2000 Krinner ..... E04H 12/2284 52/155
6,370,838 B1 * 4/2002 Evason ..... E06B 3/66342 52/786.13
6,732,477 B1 5/2004 Thomas
6,892,743 B2 * 5/2005 Armstrong ..... A01G 9/16 135/143
7,730,672 B2 * 6/2010 Knudson ..... E04D 13/076 52/12
7,810,537 B2 * 10/2010 Mayle ..... B29C 66/80 156/497
8,650,820 B2 * 2/2014 Bocquet ..... E04C 5/127 52/223.8
8,931,226 B2 * 1/2015 Thorton ..... E04F 15/22 52/403.1
8,944,718 B2 * 2/2015 Smith ..... F16D 1/0847 403/371
9,016,971 B2 * 4/2015 Masi ..... F16F 1/3863 403/228
9,353,533 B2 * 5/2016 Carrubba ..... E04F 13/0826
9,915,070 B2 * 3/2018 Lenney ..... E04D 13/064
2006/0137294 A1 * 6/2006 Waits, Jr. ..... F16B 5/01 52/787.1
2011/0107683 A1 5/2011 Ringuette

OTHER PUBLICATIONS

Feiyang, "Buchner Funnel Flask Adapter Set, Tapered Collar Green 8 sizes" https://www.amazon.com/dp/B07B7PT5C7/ref=sspa_dk_detail_0?psc=1&pd_rd_i=B07B7, retrieved Aug. 30, 2018, 5 pages.
Fountains n Slate, " Rubber Stopper Plug (705)" https://www.fountainsnslate.com/inc/sdetail/17/17801, retrieved Sep. 4, 2018, 2 pages.
Widgetco, "#7 Rubber Stoppers with 1 hole" https://www.amazon.com/dp/B01311UXBU/ref=sspa_dk_detail_4?psc=1&pd_rd_i=B013, retrieved Aug. 30, 2018, 5 pages.

* cited by examiner

FASCIA SAVER DEVICE AND SYSTEM

CROSS-REFERENCE TO RELATED APPLICATIONS

This application claims the benefit of U.S. Provisional Application No. 62/750,634, filed 2018 Oct. 25, incorporated herein by reference.

TECHNICAL FIELD

This specification relates to rainwater gutters for residential buildings.

BACKGROUND

Eaves gutters are commonly installed on the eaves of sloping roofs. A gutter catches rainwater running off the edge of the roof, channeling it to a downspout. Without an eaves gutter, rainwater will fall to the ground near the foundation of the building. This can cause problems for the foundation, with water seeping into the basement or splashing back up under the siding. A cascade of water falling from the eaves can be very erosive, causing dirt to erode away from the foundation. At ground level the downspout typically makes a turn to a more horizontal direction and the rainwater is gently deposited across a yard surrounding the building. Alternatively, the downspout can empty to piping that leads to a street gutter. Rainwater deposited in the street gutter then flows to a municipal storm water removal system.

A standard roof system typically has fascia boards running the length of the eaves. The primary purpose of the fascia boards is to support the eaves gutters and may support soffits as well. The fascia boards also have an aesthetic purpose as the hide the rough ends of the roof rafters with a smooth finished and painted surface. The eaves gutters are typically mounted to the fascia boards with a nail or screw. However, the nail makes a hole in the back of the gutter. Rainwater can seep along the nail and through the hole, dripping down in a gap behind the gutter. This water can discolor or otherwise damage the fascia board. What is needed is a device and a system to prevent rainwater from seeping through the nail hole and damaging the fascia board.

BRIEF DESCRIPTION OF THE DRAWINGS

The accompanying drawings, which are incorporated into and constitute a part of this specification, illustrate one or more embodiments of the inventive subject matter and, together with the detailed description, serve to explain the principles and implementations thereof. Like reference numbers and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

DETAILED DESCRIPTION

In describing the one or more representative embodiments of the inventive subject matter, use of directional terms such as "upper," "lower," "above," "below", "in front of" "behind," etc., unless otherwise stated, are intended to describe the positions and/or orientations of various components relative to one another as shown in the various Figures and are not intended to impose limitations on any position and/or orientation of any component relative to any reference point external to the Figures.

In the interest of clarity, not all of the routine features of representative embodiments of the inventive subject matter described herein are shown and described. It will, of course, be appreciated that in the development of any such actual implementation, numerous implementation-specific decisions must be made in order to achieve specific goals, such as compliance with application and business related constraints, and that these specific goals will vary from one implementation to another and from one developer to another. Those skilled in the art will recognize that numerous modifications and changes may be made to the representative embodiment(s) without departing from the scope of the claims. It will, of course, be understood that modifications of the representative embodiments will be apparent to those skilled in the art, some being apparent only after study, others being matters of routine mechanical, chemical and electronic design. No single feature, function or property of the representative embodiments is essential. In addition to the embodiments described, other embodiments of the inventive subject matter are possible, their specific designs depending upon the particular application. Any embodiment described as "comprising" includes the case of "consisting only of." The scope of the inventive subject matter should not be limited by the particular embodiments herein described but should be defined only by the appended claims and equivalents thereof.

REPRESENTATIVE EMBODIMENT

Figure 1:
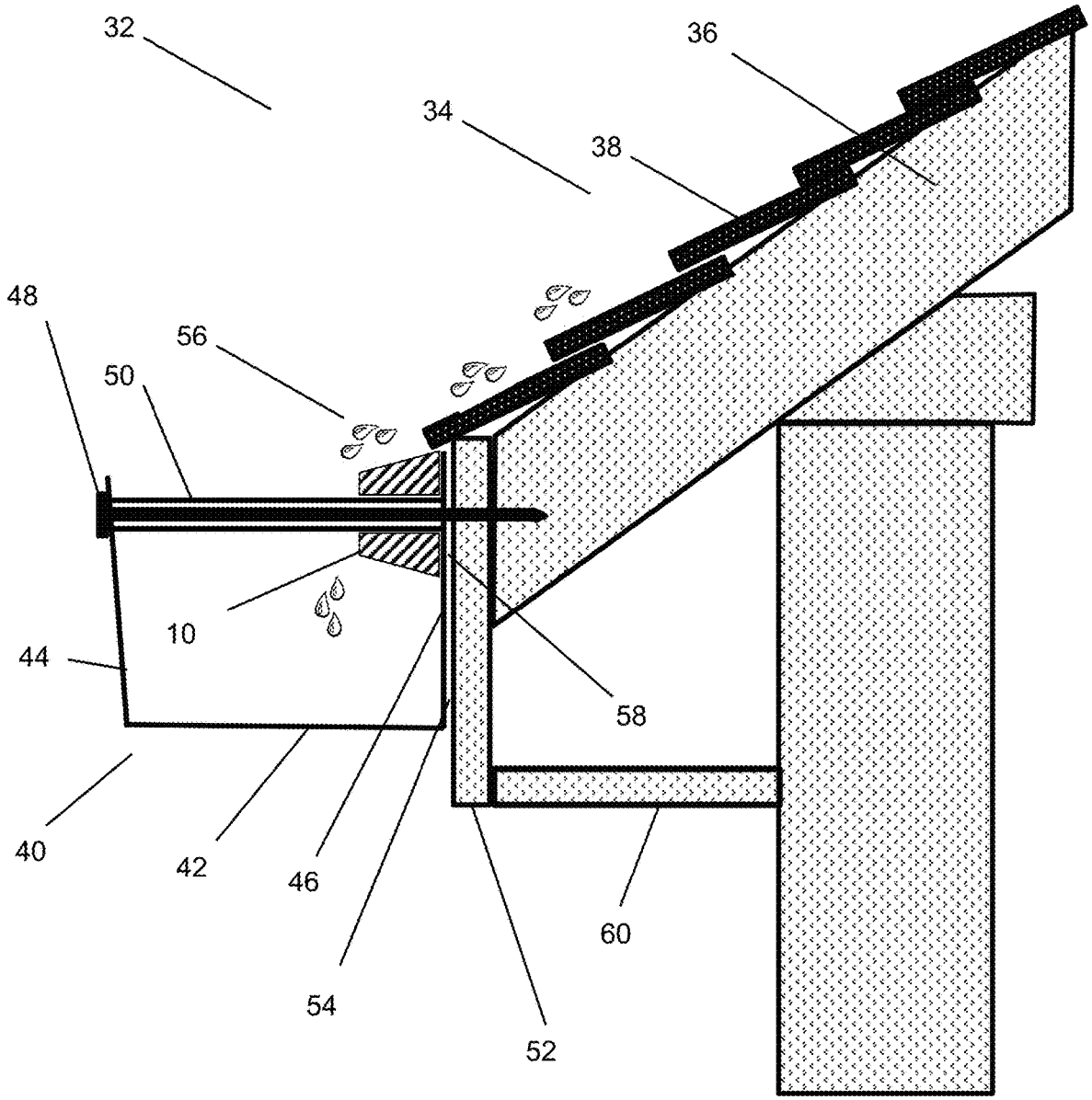
FIG. 1 shows a representative embodiment of a fascia saving gutter system with a roof of a building and a gutter along the edge of the roof.

FIG. 1 shows a representative embodiment of a fascia saving gutter system 32 with a roof 34 of a building and a gutter 40 along the edge of the roof 34. The roof 34 comprises one or more roof rafters 36 with shingles 38 mounted over them in an overlapping fashion. There may be sheathing and flashing between the shingles 38 and the roof rafters 36 as well. The fascia saving gutter system 32 has one or more fascia boards 52 running along the eaves, coupled to the ends the roof rafters 36, typically with nails or screws. The fascia boards 52 support the gutter 40 and one or more soffits 60.

The gutter 40 is a thin walled trough, with a gutter front 44, a gutter back 46, and a gutter bottom 42. The gutter 40 is made of sheet metal, but in other embodiments may be made of plastic or other suitable materials or combination of materials. The gutters 40 are mounted to the fascia boards 52 with a fastener 48. In the representative embodiment, the fastener 48 is a nail, but in other embodiments it is a screw or other suitable fastener. In the representative embodiment, the fastener 48 passes through both the gutter front 44 and the gutter back 46. Passing the fastener 48 through the gutter front 44 provides additional support to bear the weight of any water in the gutter 40, preventing the gutter bottom 42 from bending.

The fascia saving gutter system 32 further comprises a ferrule 50. The ferrule 50 is a rigid tube, cylindrical and made of metal, but in other embodiments may be a rigid tube of a different cross-sectional shape and may comprise other suitable materials. The ferrule 50 holds the gutter front 44 and gutter back 46 apart, preventing the fastener 48 from being driven in during installation, bending the gutter front 44 back towards the gutter back 46. During installation, the fastener 48 passes through the gutter front 44, through the ferrule 50, through a gutter fastener hole 58 in the gutter back 46, into the fascia board 52 and into the roof rafter 36. Some fastener 48 may miss one of the roof rafters 36 and only be held in place by the fascia board 52. Holes may be pre-drilled through the gutter front 44 and gutter back 46 prior to passing the fastener 48 through. Alternatively, the fastener 48 may be hammered through, creating holes in the gutter front 44 and gutter back 46 as it goes.

Figure 2:
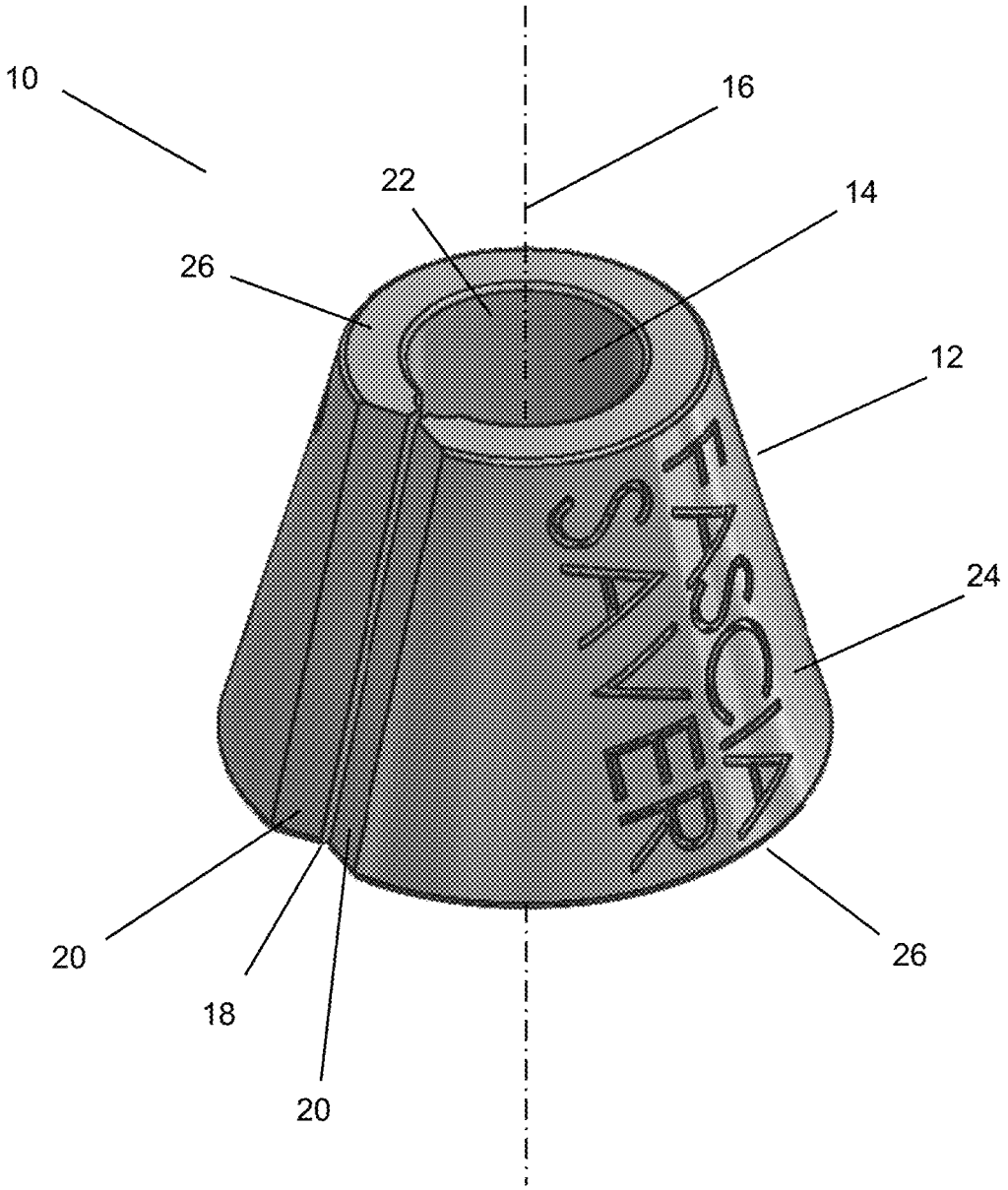
FIG. 2 shows a perspective view of a representative embodiment of a fascia saver.
Figure 3A:
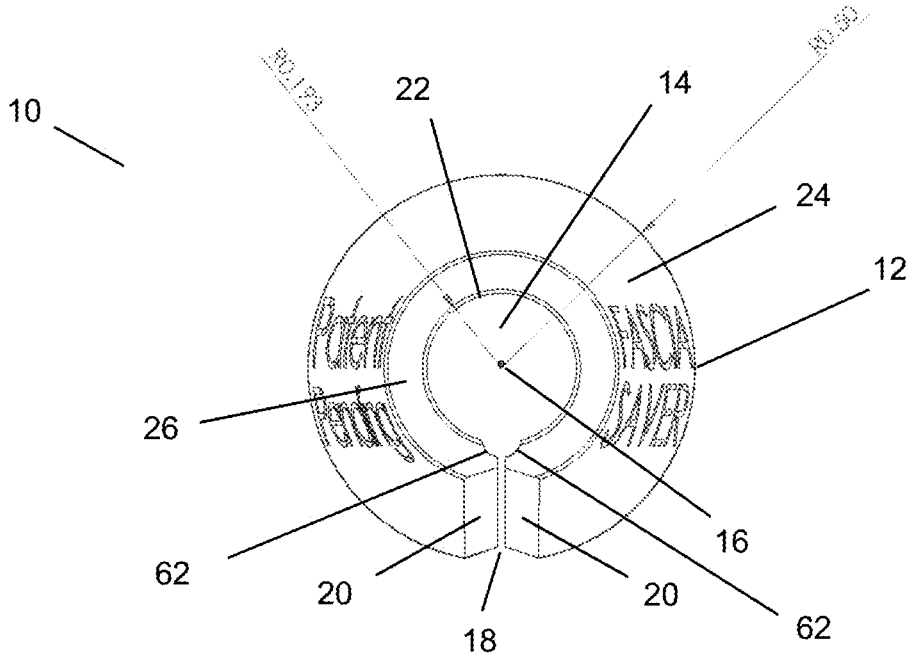
FIG. 3A shows a top view of a representative embodiment of a fascia saver.
Figure 3B:
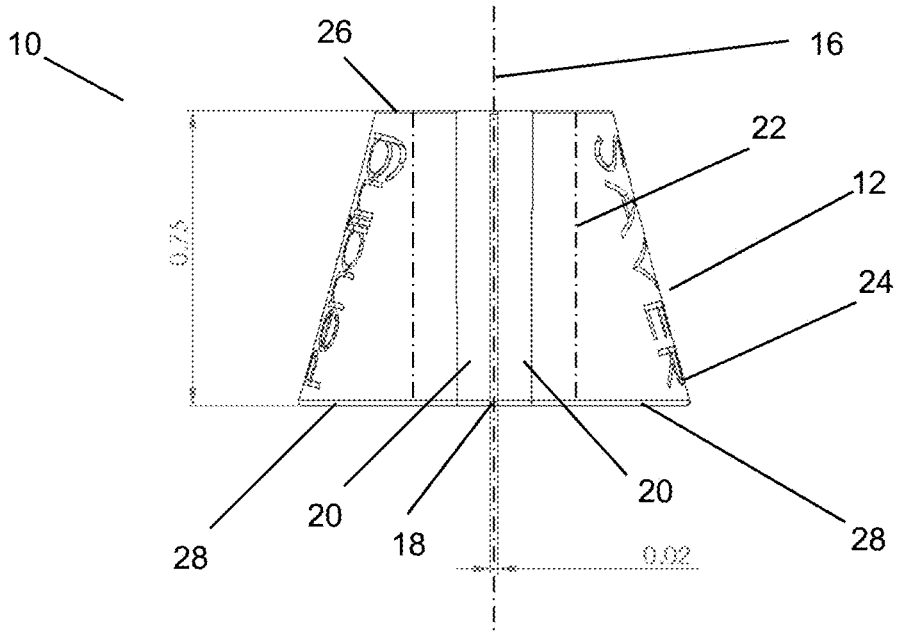
FIG. 3B shows a front view of a representative embodiment of a fascia saver.

The fascia saving gutter system 32 further comprises a fascia saver 10. FIGS. 2, 3A, and 3B show a perspective view, a top view and a front view of representative embodiment of a fascia saver 10. The fascia saver 10 is positioned around the ferrule 50 and contacting the gutter back 46. The fascia saver 10 prevents rainwater 56 from entering the gutter fastener hole 58, passing into the fascia gap 54 between the gutter back 46 and the fascia board 52.

The fascia saver 10 comprises a truncated cone body 12 of elastic material with a center cavity 14 through the truncated cone body 12. The truncated cone body 12 has a body exterior wall 24, a body interior wall 22, a body top wall 26, and a body bottom wall 28. The body interior wall 22 defines the center cavity 14. The truncated cone body 12 has a longitudinal slit 18 between the body exterior wall 24 and the body interior wall 22. In the representative embodiment, the elastic material that the truncated cone body 12 is made of is rubber. In other embodiments, the elastic material may be silicone or other suitable material.

In the representative embodiment, the center cavity 14 is cylindrical, but in other embodiments, the center cavity 14 may have other suitable shapes. The center cavity 14 has a shape that will form a tight fit with the ferrule 50 with which it is to be used, at least a tight fit at the ends of the center cavity 14 where the ferrule 50 enters and exits. The truncated cone body 12 has a longitudinal axis 16 that passes through the center cavity 14. In the representative embodiment, both the center cavity 14 and the truncated cone body 12 are coaxial on the longitudinal axis 16, but in other embodiments, the center cavity 14 may be off center with respect to the longitudinal axis 16 of the truncated cone body 12. The center cavity 14 has an internal radius of 0.19 inches in the representative embodiment. This is the best dimension for the ferrules 50 commonly in use today. However, in other embodiments, other dimensions may be used.

In the representative embodiment, the fascia saver 10 has outward facing bevel edges 20 in the truncated cone body 12 on each side of the longitudinal slit 18. Other embodiments may omit the outward facing bevel edges 20. The outward facing bevel edges 20 facilitate slipping the fascia saver 10 over the ferrule 50 during installation. In the representative embodiment, the outward facing bevel edges 20 are chamfered so that the truncated cone body 12 does not become too thin at the point nearest the longitudinal slit 18, which would make the truncated cone body 12 easily susceptible to damage. In the representative embodiment, the fascia saver 10 has inward facing bevel edges 62 on each side of the longitudinal slit 18. Like the outward facing bevel edges 20, the inward facing bevel edges 62 are chamfered so that the truncated cone body 12 does not become too thin at the point nearest the longitudinal slit 18. The inward facing bevel edges 62 facilitate removing the fascia saver 10 from the ferrule 50 without damaging the fascia saver 10. The inward facing bevel edges 62 are concave. In other embodiments, the inward facing bevel edges 62 may not be concave or may omit the inward facing bevel edges 62 altogether.

What is claimed is:

1. A facia saving gutter system comprising:

a fascia saver, wherein the fascia saver has a truncated cone body of elastic material with a center cavity through the truncated cone body along a longitudinal axis of the truncated cone body, the truncated cone body with a longitudinal slit through the truncated cone body; and wherein the truncated cone body has an outward facing bevel edge on each side of the longitudinal slit, each outward facing bevel edge between an outer surface of the truncated cone body and the longitudinal slit.

2. The facia saving gutter system of claim 1, wherein the outward facing bevel edges are chamfered.

3. A facia saving gutter system comprising:

a gutter attached to a building wherein the gutter has a gutter bottom and a gutter front and a gutter back, wherein the gutter back is in contact with the building;

a fastener passing through the gutter front, through the gutter back, and into the building;

a ferrule positioned inside the gutter with the fastener passing through the ferrule;

a fascia saver positioned around the ferrule and contacting the gutter back, wherein the fascia saver has a truncated cone body of elastic material with a center cavity through the truncated cone body along a longitudinal axis of the truncated cone body, the truncated cone body with a longitudinal slit through the truncated cone body; and wherein the truncated cone body has inward facing bevel edges on each side of the longitudinal slit.

4. The facia saving gutter system of claim 3, wherein the inward facing bevel edges are chamfered and concave.

5. The facia saving gutter system of claim 3, wherein the truncated cone body has outward facing bevel edges on each side of the longitudinal slit;

wherein the outward facing bevel edges are chamfered; and wherein the inward facing bevel edges are chamfered and concave.

6. A fascia saver device comprising:

a truncated cone body of elastic material;

a center cavity through the truncated cone body along a longitudinal axis of the truncated cone body;

a longitudinal slit through the truncated cone body; and wherein the truncated cone body has inward facing bevel edges on each side of the longitudinal slit.

7. The fascia saver device of claim 6, wherein the truncated cone body has an outward facing bevel edges on each side of the longitudinal slit, each outward facing bevel edge between an outer surface of the truncated cone body and the longitudinal slit.

8. The fascia saver device of claim 7, wherein the outward facing bevel edges are chamfered.

9. The fascia saver device of claim 6, wherein the inward facing bevel edges are chamfered and concave.

10. The fascia saver device of claim 6, wherein the truncated cone body has outward facing bevel edges on each side of the longitudinal slit;

wherein the outward facing bevel edges are chamfered; and wherein the inward facing bevel edges are chamfered and concave.

* * * * *